US006286920B1

(12) United States Patent
Ridgway

(10) Patent No.: US 6,286,920 B1
(45) Date of Patent: Sep. 11, 2001

(54) VENETIAN BLIND PRINTING SYSTEM

(76) Inventor: Paul Anthony Ridgway, Box 1435, Julian, CA (US) 92036

( * ) Notice: Subject to any disclaimer, the term of this patent is extended or adjusted under 35 U.S.C. 154(b) by 0 days.

(21) Appl. No.: 09/364,349

(22) Filed: Jul. 29, 1999

(51) Int. Cl.[7] ..... B41J 3/00
(52) U.S. Cl. ..... 347/2; 347/4
(58) Field of Search ..... 347/2, 4, 14, 16, 347/105, 107, 40, 44, 106; 400/112–114

(56) References Cited

U.S. PATENT DOCUMENTS

| | | | | |
|---|---|---|---|---|
| 4,848,942 | * | 7/1989 | Speicher | 400/112 |
| 5,022,296 | | 6/1991 | Eschauzier et al. | 82/27 |
| 5,050,662 | | 9/1991 | Kellener | 160/168.1 |
| 5,135,317 | | 8/1992 | Greenwood et al. | 400/120 |
| 5,269,361 | | 12/1993 | Ryden et al. | 160/236 |
| 5,281,290 | | 1/1994 | Bosler | 156/230 |
| 5,447,758 | | 9/1995 | Pelletier | 427/511 |
| 5,618,120 | * | 4/1997 | Ishikawa | 400/708 |
| 5,636,676 | | 6/1997 | Fishlin | 160/168.1 |
| 5,671,667 | | 9/1997 | Simmet | 101/35 |
| 5,795,491 | * | 8/1998 | Ciriaci | 216/28 |
| 5,831,641 | * | 11/1998 | Carlson | 347/2 |

* cited by examiner

*Primary Examiner*—John Barlow
*Assistant Examiner*—Juanita Stephens
(74) *Attorney, Agent, or Firm*—Dan Hubert & Assoc.

(57) ABSTRACT

Print heads with arcuate printing surfaces are used to apply images to elongated, laterally curved slats prior to their assembly into Venetian blinds. Each print head includes a print head casing having a concave or convex printing surface forming an arc shape. The print heads are distributed in series along a slat path, which is defined by a conveyor. One or more ink wells are coupled to the print head casing; each ink well may contain a separate color of ink. Many print jet orifices are evenly distributed along the printing surface, and may be arranged in an array with multiple rows and columns, for example. Each print jet orifice is coupled to one of the ink wells by a supply path. During the printing process, slats are longitudinally advanced along the slat path past the print heads. A controller regulates the slat's position relative to the print heads, and controls the position using the conveyor. At selected times, depending upon the slat's position, the controller activates selected ink jets of selected print heads to eject ink upon the curved slat, and thereby imprint a desired image upon the slat. The images imprinted on individual slats are coordinated to provide a desired, overall image spanning the Venetian blinds.

28 Claims, 5 Drawing Sheets

FIGURE 1
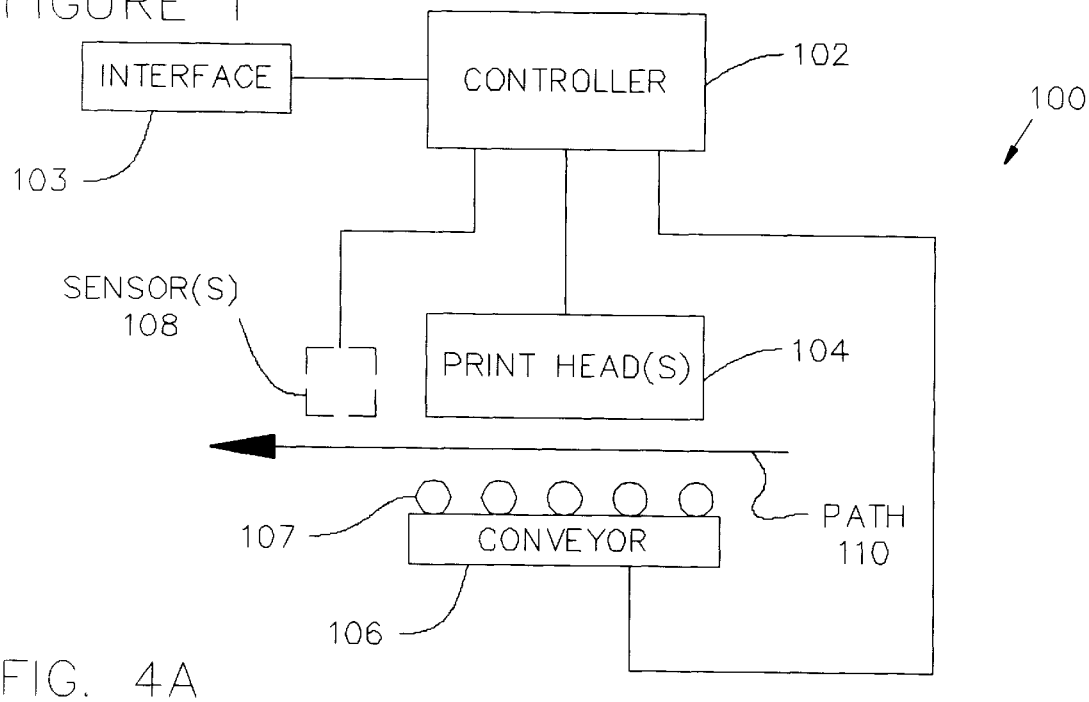
FIG. 4A
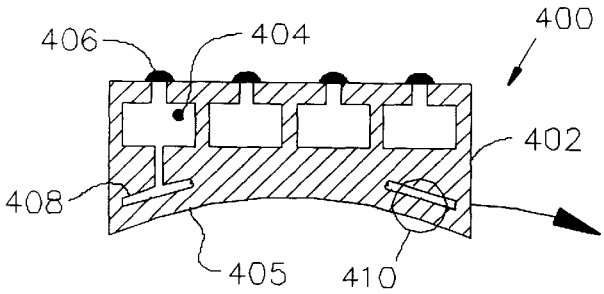
FIG. 4B
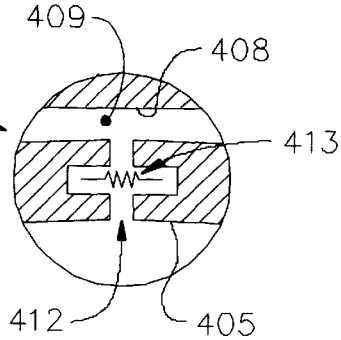
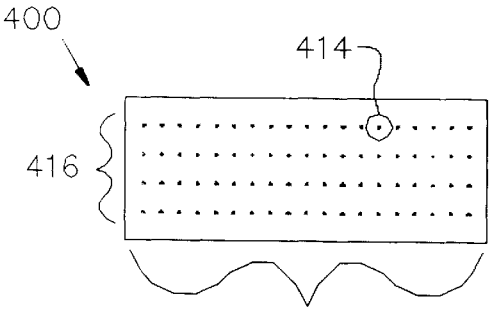
FIG. 4C
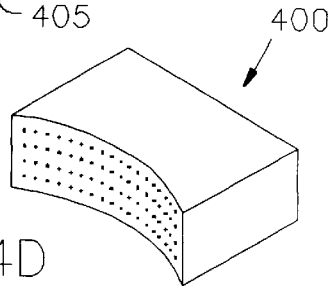
FIG. 4D FIGURE 6
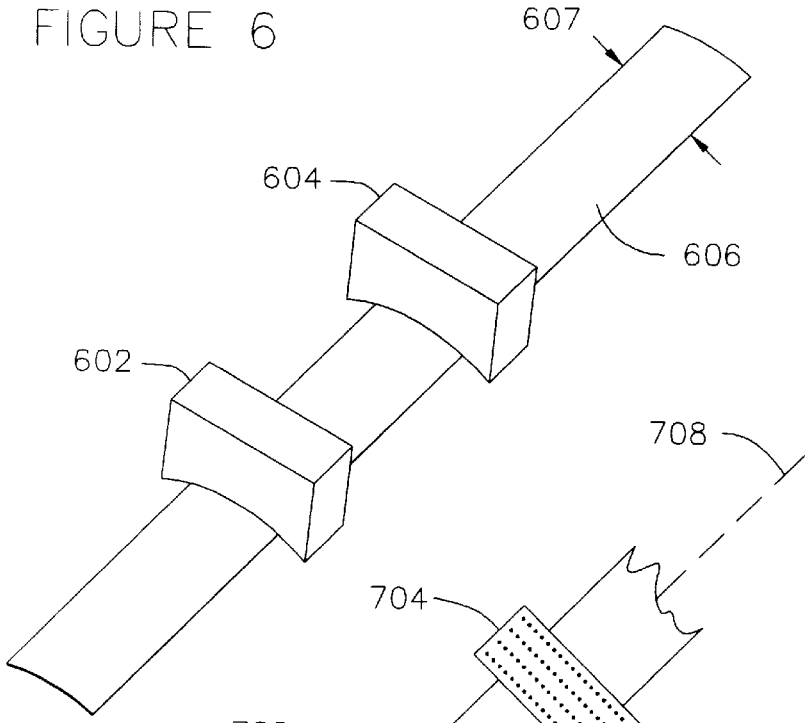
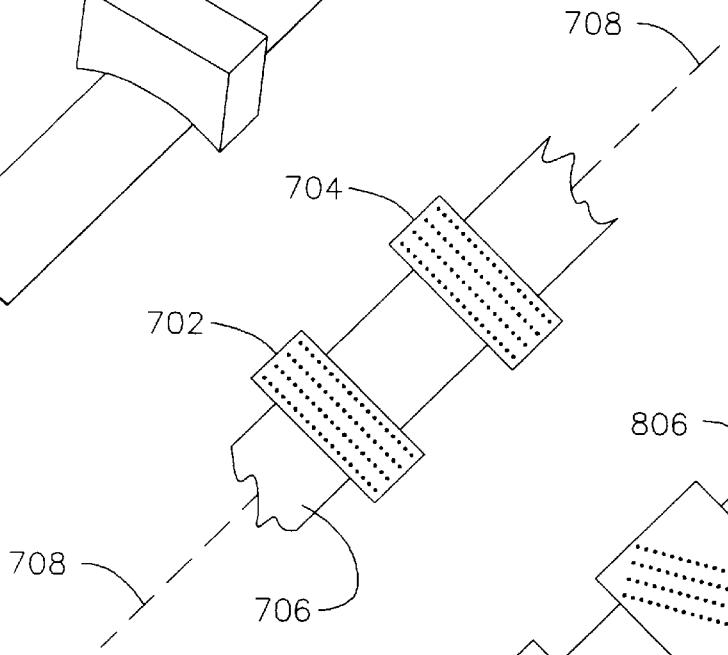
FIGURE 7
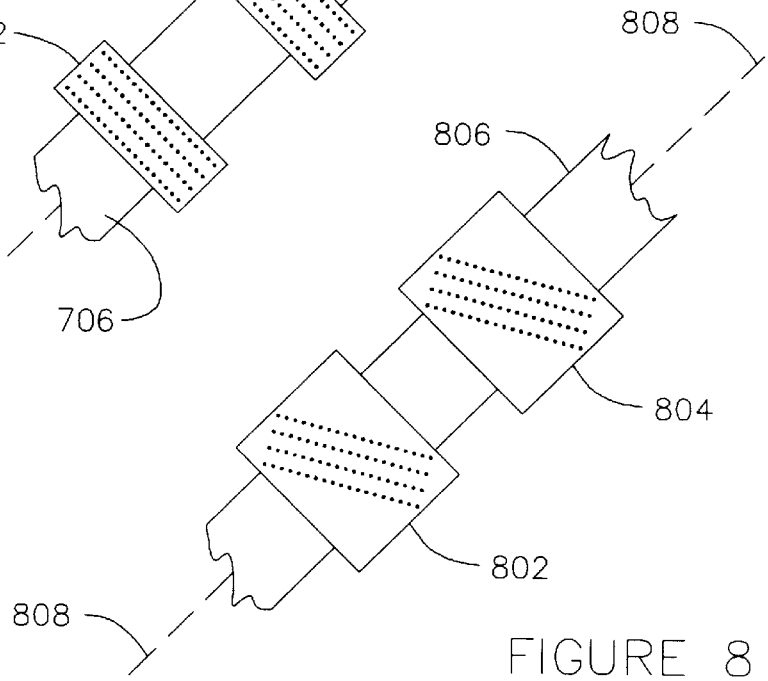
FIGURE 8

VENETIAN BLIND PRINTING SYSTEM

BACKGROUND OF THE INVENTION

1. Field of the Invention

The present invention relates to the field of printing, and more particularly to the use of curved multi-jet print heads to print upon laterally curved slats prior to their assembly into louvred structures such as Venetian blinds.

2. Description of the Related Art

From typewriters to laser operated graphics printers, the printing field is ripe with printing devices. Despite the tremendous breadth of potential surfaces to be printed upon, engineers have designed a correspondingly broad selection of printers for many of these jobs. In addition to the usual paper jobs, equipment for printing, engraving, stamping, and the like has been developed for vinyl signs, CD-ROMs, plastics, metals, and many other materials. Airplane sky-writing fills an unusual need to place text in the sky, further attesting to mankind's ingenuity in printing just about anywhere.

Engineers still encounter some substantial challenges, however, when seeking to print upon certain types of surfaces. One difficult surface is the narrow, curved surface of a Venetian blind slat. It may be desirable to apply printing to Venetian blind slats, for example, to spruce-up normally bland Venetian blind slats by covering the slats with a nature scene, wood grain, photograph, etc.

One conventional approach employs a screen printing technique to print directly onto flat Venetian blind slats. After this, the slats are bent into the desired curvature. Although this approach is desirable for its ease of printing, the bending of the Venetian blind slats may damage or distort the overall image. For example, bending the slat may crack the slat or the printing material thereon. Another approach prints upon flat paper with adhesive backing, divides the paper into strips of suitable dimensions, and then adheres the strips onto Venetian blind slats. As with the previous approach, this process may also cause some distortion to the image, since its flat printing does not account for the ultimately curved shape of the image. Additionally, this approach may also be costly because sufficient adhesive paper is required to completely cover the Venetian blind slats, or else risk an unsightly division between the adhesive paper and the uncovered regions of the slats. Even with adhesive paper that matches the color of the Venetian blinds, the two materials may ultimately take on different appearances due to diverging wear, dust resistance, dirt accumulation, etc.

In contrast to the foregoing methods, another technique uses silk screening to apply the desired image directly onto the blind slats. Silk screening ink is typically flexible, and therefore resists cracking due to flexure. Nonetheless, problems have been encountered with silk screening, too. During silk screening, the screen must be kept taut. As a result, the ink does not flow evenly over the curved surface of the slats, and may even run. Moreover, this procedure is time consuming and expensive because it requires a different individual screen for each slat. Costs can be saved by applying the same image to some or all of the slats in suitable applications, e.g., where the original image contains non-distinct elements, such as ornamental patterns, leaves, wood grain, etc. Another problem with silk screening is that an entirely new set of screens must be created to lay down an image on Venetian blinds with different dimensions.

Consequently, known techniques for printing upon Venetian blinds with curved slats are not completely adequate for some applications due to certain unsolved problems.

SUMMARY OF THE INVENTION

Broadly, the present invention uses curved print heads to print upon elongated, laterally curved slats prior to their assembly into Venetian blinds. Each print head includes a print head casing having a concave or convex printing surface forming an arc. The print heads are distributed in series along a slat path, which is defined by a conveyor. One or more ink wells are coupled to the print head casing; each ink well may contain a separate color of ink. Many print jet orifices are defined in the printing surface, and may be arranged in a multi-row, multi-column array, for example. Each print jet orifice is coupled to one of the ink wells by an ink path, and further includes an activator to forcibly eject ink from the orifice onto the slat.

During the printing process, slats are longitudinally advanced along the slat path past the print heads. A controller regulates the slat's position using machinery including the conveyor. At selected times, depending upon the slat's position, the controller activates specific ink jets of certain print heads to eject ink upon the curved slat, and thereby imprint a desired image upon the slat. The images imprinted on individual slats are coordinated to provide a desired, overall image spanning the Venetian blinds.

Accordingly, the invention may be implemented to provide a method of printing upon curved Venetian blind slats; a different embodiment is a slat or other product manufactured with such a process. In another embodiment, the invention may be implemented to provide an apparatus such as a print head or printing system for printing on curved Venetian blind slats. In still another embodiment, the invention may be implemented to provide a signal-bearing medium tangibly embodying a program of machine-readable instructions executable by a digital data processing apparatus to perform operations for printing upon curved Venetian blind slats. Another embodiment concerns logic circuitry having multiple interconnected electrically conductive elements configured to perform operations to perform operations for printing upon curved Venetian blind slats.

The invention affords its users with a number of distinct advantages. Unlike silk screening techniques, the curved print heads lay down ink more evenly and help avoid ink running. Additionally, since the invention prints on pre-curved surfaces, the resultant images are not subjected to distortion or cracking when subsequently bent into a desired curved shape. As another advantage, the printing system of this invention can employ computer software to adjust the size of the image to suit different sizes of Venetian blinds. The use of computer software facilitates printing images with great visual diversity from slat to slat, in contrast to previous approaches where some or all slat images are redundant. The invention also provides a number of other advantages and benefits, which should be apparent from the following description of the invention.

BRIEF DESCRIPTION OF THE DRAWINGS

FIG. 1 is a block diagram of the hardware components and interconnections of a Venetian blind printing system, according to the invention.

FIG. 4A is a side cross-sectional view of a print head according to the invention.

FIG. 4B is an exploded partial cross-sectional side view of an area 410 of the print head of FIG. 4A.

FIG. 4C is a bottom plan view of a concave embodiment of print of the invention.

FIG. 4D is a perspective view of a concave embodiment of print head of the invention.

FIG. 6 is a perspective view showing the relative arrangement of print heads and a Venetian blind slat during printing, according to the invention.

FIGS. 7–8 are plan views showing exemplary arrangements of print heads and print jet orifices respective to a Venetian blind slat during printing, according to the invention.

DETAILED DESCRIPTION

Figure 2:
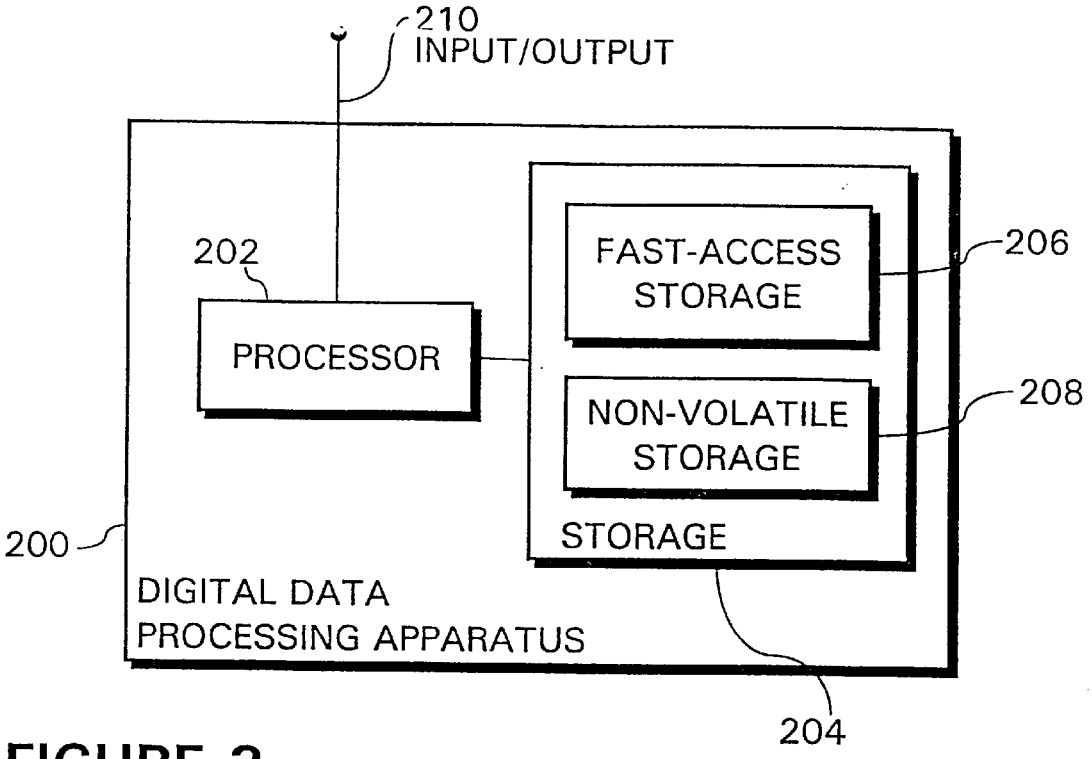
FIG. 2 is a block diagram of a digital data processing machine according to the invention.

The nature, objectives, and advantages of the invention will become more apparent to those skilled in the art after considering the following detailed description in connection with the accompanying drawings. As mentioned above, the invention concerns a Venetian blind printing system employing curved multi-jet print heads to print upon laterally curved slats prior to their assembly into Venetian blinds.

Hardware Components & Interconnections

Venetian Blind Printing System

Introduction

One aspect of the invention concerns a system for printing on elongated, curved surfaces such as individual slats of Venetian blinds. Without any intended limitation, the following examples discuss the particular embodiment where ink is printed upon Venetian blind slats. Nonetheless, the invention may also be used to apply other printing materials (not necessarily ink) to other print media with curved surfaces (not necessarily Venetian blinds) with a relatively large longitudinal dimension and smaller lateral dimension. The invention also contemplates print media such as mini-blinds, vertical blinds, partition blinds, shutters, louvred doors or partitions, billboards with slats that move to reveal alternate images, etc. For ease of discussion, these are referred to as louvred structures and discussed in the context of Venetian blinds as a representative example.

The invention may be embodied by various hardware components and interconnections, such as the exemplary system 100 shown in FIG. 1. The system 100 includes a controller 102, an interface 103, one or more print heads 104, a conveyor 106, and (optionally) one or more sensors 108. These components are interconnected as shown, and such interconnection may be made by wires, cables, busses, fiber optics, wireless transmission, etc. Broadly, the print heads 104 are fixedly mounted, and the conveyor 106 moves the slats along a path 110 that passes each head in succession.

Controller

Broadly, components of the system 100 operate under direction of the controller 102. As the controller 102 directs the conveyor 106 to move a print medium or "workpiece" along a path 110, the controller 102 also engages the stationary print head(s) 104 at appropriate times. The workpiece may comprise a Venetian blind slat, for example. As discussed below, the print heads 104 are unique in that each head bears a curved print surface facing the path 110, which is especially suitable for printing on the slat's curved surface.

As one example, the controller 102 may be embodied by a digital data processing apparatus such as the apparatus 200 shown in FIG. 2. The apparatus 200 includes a processor 202, such as a microprocessor or other processing machine, coupled to a storage 204. In the present example, the storage 204 includes a fast-access storage 206, as well as nonvolatile storage 208. The fast-access storage 206 may comprise random access memory ("RAM"), and may be used to store the programming instructions executed by the processor 202. The nonvolatile storage 208 may comprise, for example, one or more magnetic data storage disks such as a "hard drive," a tape drive, or any other suitable storage device. The apparatus 200 also includes an input/output 210, such as a line, bus, cable, electromagnetic link, or other means for the processor 202 to exchange data with other hardware external to the apparatus 200.

Despite the specific foregoing description, ordinarily skilled artisans (having the benefit of this disclosure) will recognize that the apparatus discussed above may be implemented in a machine of different construction, without departing from the scope of the invention. As a specific example, one of the components 206, 208 may be eliminated; furthermore, the storage 204 may be provided on-board the processor 202, or even provided externally to the apparatus 200.

As an alternative to the foregoing digital data storage apparatus, a different embodiment of the invention uses logic circuitry instead of computer-executed instructions. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented using CMOS, TTL, VLSI, or another suitable construction. Other alternatives include a digital signal processing chip (DSP), discrete circuitry (such as resistors, capacitors, diodes, inductors, and transistors), field programmable gate array (FPGA), programmable logic array (PLA), and the like.

Interface

The interface 103 assists the controller 102 in communications with external data input/output, such as a scanner, computer, storage read/write device, human user, control system, host computer system, communications network, etc. The interface 103 may include various components, depending upon cost, user sophistication, and other requirements of the application. In the case of a human user, these components may include a keyboard, keypad, video screen, computer monitor, computer mouse, trackball, digitizing pad, voice activation software, foot pedals, dials, knobs, switches, etc. In the case of an electronic or mechanized user, the components of the interface 103 may comprise a wire, signal bus, telephone modem, radio frequency link, microwave link, infrared link, computer network, or other equipment.

Conveyor & Sensor(s)

The conveyor 106 operates under direction of the controller 102 to advance the workpieces (such as Venetian blind slats) along the path 110, and thereby past the stationary print heads 104. The conveyor 106 may be implemented using various components or combinations thereof, such as conveyor belts, wheeled chassis, sliding undercarriage, x-y positioning system, or another suitable mechanism for reliable moving the workpiece past the print heads 104 with prescribed distance, speed, and other position or motion related characteristics. FIG. 1 shows wheels (such as 107) to illustrate the conveyor belt option, as one specific example.

The workpiece may be held in place by gravity, static electricity, vacuum mounting, clamps, weights, clips, or any other suitable mechanism. To provide one specific example, the conveyor 106 may comprise an x-y positioning system that mounts the workpiece to a conveyance panel, which is controllably positioned using a number of highly precise stepper motors. Further details of the conveyor 106 should be apparent to ordinarily skilled artisans (having the benefit of this disclosure), especially in view of workpiece positioning mechanisms in commercially available products such as plotters.

The conveyor 106 is used in conjunction with the optional sensor(s) 108, which comprise one or more mechanisms for sensing the position of the workpiece as it transits the path 110. For this purpose, each sensor 108 may comprise an optical emitter/sensor pair such as a light-emitting diode and matching photodiode or phototransistor. Other examples include mechanical triggers, sensors for measuring electrical parameters such as resistance, etc. Although shown apart from the conveyor 106, the sensors 108 may be integrated into the conveyor 106. The sensors 108 may operate by sensing the position of the slat itself (such as optically), detecting an identifiable part of the conveyor itself (such as a prescribed light-reflective or transmissive piece), or internal characteristics of the conveyor 106 (such as the orientation of stepper motors of the conveyor). Alternatively, the sensors 108 may be omitted, by monitoring advancement of the conveyor 106, or command signals issued by the controller 102 to the conveyor 106 to direct movement of the conveyor, instead of workpiece motion. If desired, the conveyor 106 may also include a collating and racking system (not shown).

Print Head

As mentioned above, the print heads 104 are distributed in succession along the path 107. Depending upon the application, each print head may apply one printing material (such as a color) or multiple such materials. Furthermore, multiple print heads may apply the same color or other printing material to increase printing speed. Alternatively, in a low volume application, the system 100 may employ a single multi-color print head.

The print heads 104 may be implemented by bubble jet, thermal, piezo, ink jet, or another technology that forcibly ejects printing material onto the print medium. Broadly, each of the one or more print heads 104 includes a print head casing, one or more wells, multiple print jet orifices, and ink paths leading from each print jet orifice to one well. FIGS. 4A–4D show an exemplary print head 400. The overall shape of the head 400 is defined largely by the casing 402, which may be formed from a combination of metal alloys and injection molded plastics, or other materials with suitable strength, thermal characteristics, chemical resistance, and other properties. Although the casing 402 may take various shapes, the illustrated casing 402 is largely box-shaped. The print head 400 exhibits a curved printing surface 405 that is either concave (as shown) or convex. The curve of the surface 405 is selected to substantially match the intended workpiece, such as a Venetian blind slat. The surface 405 bears many print jet orifices, best shown in FIG. 4C and exemplified by the print jet orifice 414. As shown, the print jet orifices may be located to provide a variety of different arrangements, one example of which is a rectangular array of columns 418 and rows 416. As an example, the print jet orifices may have a linear density of about forty-eight per inch.

Figure 4E:
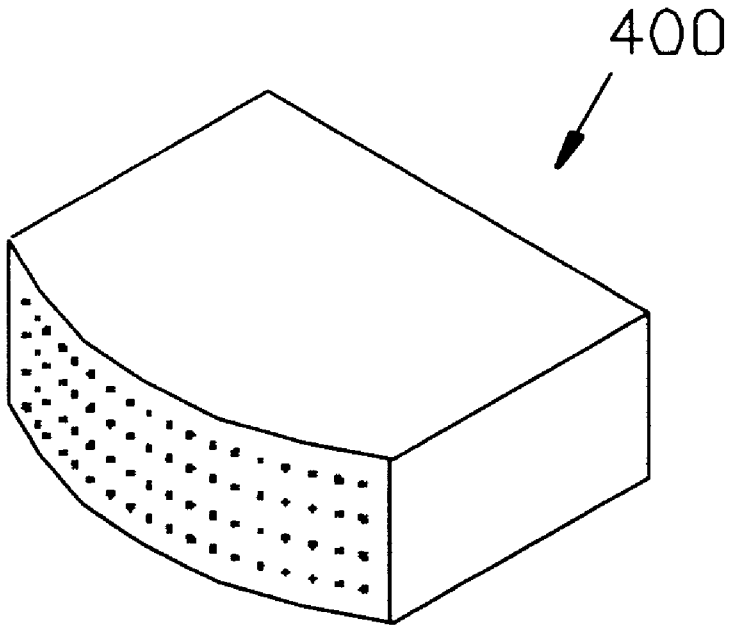
FIG. 4E is a perspective view of a convex embodiment of print head of the invention.

The casing 402 defines one or more internal wells, such as the well 404, shown in FIG. 4A. Alternatively, the wells may be external to the casing 402, with appropriate plumbing to route contents of the wells to the print jet orifices. The wells, such as 404, are designed to hold liquid, solid, or gaseous ink, textured printing material, paint, clear laquer, Pantone, ultraviolet inks, curing accelerators, or other printing material. If located internally of the casing 402, the wells may be covered and sealed by structure such as the cap 406. As an example, the four wells shown in FIG. 4A may be used to hold different colors of ink, such as cyan, magenta, yellow, and black.

In the example of FIGS. 4C–4D, each of the wells is coupled to a different row 416 or column 418 of print jet orifices. In this example, four rows of print jet orifices are shown, e.g., first row cyan, second row magenta, third row yellow, fourth row black. Alternatively, to provide a monochrome print head, the wells may hold the same printing material, such as black ink. Each well 404 is coupled to a supply path leading to a number of individual print jet orifices. Conversely, each print jet orifice is only coupled to one ink well. In the illustrated example, with four wells are provided to house cyan, magenta, yellow, and black inks, and each well is exclusively coupled to certain print jet orifices by separate supply paths. In the illustrated example, the supply path is implemented by distribution conduits (e.g., 408), each extending from one end of the casing 402 to the other. The distribution conduits enable less complicated routing of printing material from the wells to the print jet orifices, rather than routing individual conduits between each well and each print jet orifice. The distribution conduit 408 is shown coupled solely to the well 404. Other distribution conduits (not shown) coupled to the other three wells may, for example, lie beneath the distribution conduit 408 from the perspective of FIG. 4A.

FIG. 4B shows an enlarged view of the area 410 containing the coupling between the distribution conduit 408 and an exemplary print jet orifice 412. Each print jet orifice is coupled to the distribution conduit 408 by a connecting conduit, such as the conduit 409 that couples the distribution conduit 408 to the print jet orifice 412. Each print head further includes an activator to cause the print jet orifice to eject printing material from the casing 402. In the case of the print jet orifice 412, the activator is shown by 413. To implement an ink jet printer, for example, the activator 413 may comprise an electrically resistive element, as illustrated in FIG. 4B.

Operation

In addition to the various hardware embodiments described above, a different aspect of the invention concerns a method for printing upon laterally curved slats prior to their assembly into Venetian blinds or other louvred structures.

Signal-Bearing Media

In the context of FIGS. 1–2, such a method may be implemented by operating the controller 102, as embodied by the digital data processing apparatus 200, to execute a sequence of machine-readable instructions and thereby manage the other components of the system 100. These instructions may reside in various types of signal-bearing media. In this respect, one aspect of the present invention concerns a programmed product, comprising signal-bearing media tangibly embodying a program of machine-readable instructions executable by a digital data processor to perform a method for printing upon laterally curved slats prior to their assembly into Venetian blinds.

Figure 3:
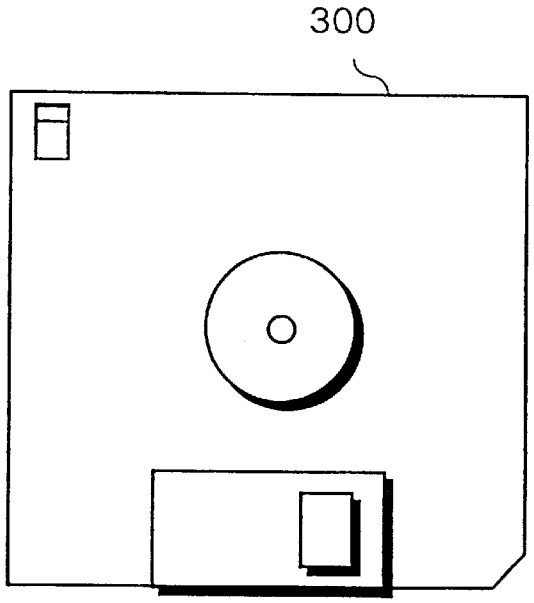
FIG. 3 shows an exemplary signal-bearing medium according to the invention.

This signal-bearing media may comprise, for example, RAM (not shown) contained within the controller 102, as represented by the fast-access storage 206 for example. Alternatively, the instructions may be contained in another signal-bearing media, such as a magnetic data storage diskette 300 (FIG. 3), directly or indirectly accessible by the controller 102. Whether contained in the controller 102, diskette 300, or elsewhere, the instructions may be stored on a variety of machine-readable data storage media, such as direct access storage (e.g., a conventional "hard drive," redundant array of inexpensive disks (RAID), or another direct access storage device (DASD)), magnetic tape, electronic read-only memory (e.g., ROM, EPROM, or EEPROM), optical storage (e.g., CD-ROM, WORM, DVD, digital optical tape), paper "punch" cards, or other suitable signal-bearing media including transmission media such as digital and analog and communication links and wireless. In an illustrative embodiment of the invention, the machine-readable instructions may comprise software object code, compiled from a language such as "C," etc.

Logic Circuitry

In contrast to the signal-bearing medium discussed above, the method aspect of the invention may be implemented using logic circuitry, without using a processor to execute instructions. In this embodiment, the logic circuitry is implemented in the controller 102, and is configured to perform operations to implement the method of the invention. The logic circuitry may be implemented using many different types of circuitry, as discussed above.

Overall Sequence of Operation

Figure 5:
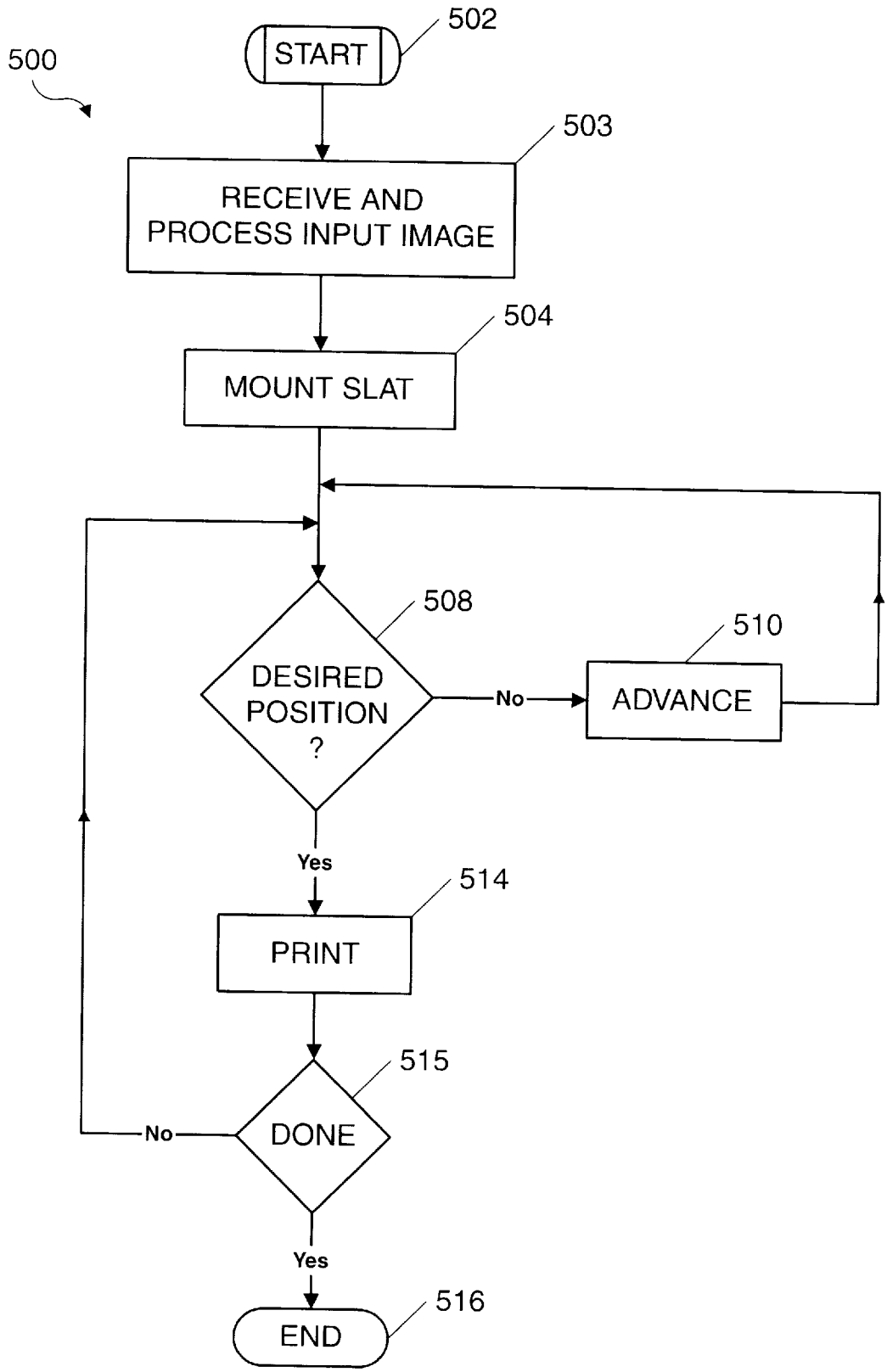
FIG. 5 is a flowchart showing one operational sequence according to the invention.

FIG. 5 shows a operating sequence 500 to provide an example of the method aspect of the present invention. For ease of explanation, but without any intended limitation, the example of FIG. 5 is described in the context of the system 100 described above. After the sequence 500 starts in step 502, the controller 102 receives an input image from the interface 103 and processes the image (step 503). The input image is intended for printing upon the Venetian blinds. The input image may be received in any machine-readable form, such as JPEG, TIFF, GIF, bit map, etc. As one example, the image may be received (step 503) by way of digitizing the input image with an optical scanner. The input image is made up of many tiny picture elements ("pixels"). As part of step 503, the controller 102 may also receive slat-related data including the number of slats, the width and length of each slat, type of slat material, etc.

In the processing operation of step 503, the controller 102 maps the input image to multiple image segments, with each segment corresponding to a single Venetian blind slat. If desired, step 503 may also perform other processing of the input image, such as re-sizing, filtering, cropping, and adjusting color characteristics such as tint, etc. In one embodiment, step 503 maps the image into non-overlapping segments, each sized to approximately match the size of one slat. To implement a more complex approach with a more aesthetic result, the segments may be generated from the input image so as to overlap slightly. Furthermore, an image altering process may be applied to blend adjacent segments and thereby smooth the overall image when applied to the Venetian blinds. Such techniques are further described in U.S. patent application Ser. No. 09/364,350, entitled "Method of Preparing Images for Printing on Venetian Blinds," filed herewith in the name of Paul A. Ridgway and incorporated herein by reference.

After the appropriate image segments are generated, step 504 mounts a slat onto the conveyor 106. As one example, this slat may be a single pre-cut Venetian blind slat; alternatively, the slat may be a longer, uncut slat suitable for later division into multiple slats. Mounting of the slat depends upon the particular type of conveyor 106 used, and may be performed manually or automatically. In the illustrated example, travel along the path 110 moves the slat forward along its own longitudinal axis.

After step 504, the controller 102 asks whether the slat is in a desired position for printing (step 508). This determination may be made, for example, by consulting the sensors 108 to sense the position of the slat. This may involve detecting the physical position of the slat itself, or by detecting the position of hardware used to mount the slat. As an alternative to using the sensors in step 508, the controller 102 may inherently sense slat position by virtue of the past movement command signals that the controller 102 has issued to the conveyor 106. At any rate, step 508 asks whether the slat is suitably positioned for the next activation of the print jet orifices. If the slat is not in the desired position, step 508 leads to step 510, where the controller 102 operates the conveyor 106 to advance the slat into the next position for printing.

When the slat arrives in the desired position, step 508 proceeds to step 514, where the controller 102 activates the print heads 104 to effectuate printing. Step 514 may serve to print images, patterns, textures, and the like.

FIG. 6 shows one exemplary print head configuration relative to a slat 606, for carrying out the printing of step 514. Namely, the print heads 602, 604 are located in parallel, so they are staged along the slat during printing. The slat 606 is curved in a lateral dimension 607. As shown in more detail in FIG. 7, print heads 702, 704 may be arranged relative to the path such that each print head spans the slat, with its rows of print jet orifices being orthogonal to the longitudinal axis 708 of the slat 706. As an alternative (not shown), the print heads 702, 704 may be arranged at an angle to the slat. FIG. 8 shows another alternative arrangement, where print heads 802, 804 are orthogonal to the longitudinal axis 808 of the slat 806, but their print jet orifices lie in rows arranged at an angle to the slat.

After printing at the current slat position is done, step 514 proceeds to step 515, which asks whether the entire image has been printed. If not, control returns to step 508. Otherwise, the sequence 500 ends in step 516.

OTHER EMBODIMENTS

While the foregoing disclosure shows a number of illustrative embodiments of the invention, it will be apparent to those skilled in the art that various changes and modifications can be made herein without departing from the scope of the invention as defined by the appended claims. Furthermore, although elements of the invention may be described or claimed in the singular, the plural is contemplated unless limitation to the singular is explicitly stated.

What is claimed is:

1. A method of printing upon elongated slats having a laterally curved surface, comprising operations of:

providing one or more print heads each having a printing surface exhibiting an arc shape approximately matching the slat's lateral curve, each print head including multiple print jets to eject print material from print jet orifices defined in the printing surface;

longitudinally advancing the slat past the print heads in series, where the curve of the slat is aligned with the arc-shaped printing surface; and at selected positions of the slat with respect to each particular print head, activating the print jets of that particular print head to eject printing material upon the curved slat.

2. The method of claim 1, further comprising operations of:

repeatedly determining the position of the slat by using sensors to ascertain the slat's position.

3. The method of claim 2, where the operation of determining position is performed using optical sensors to ascertain the slat's position.

4. The method of claim 1, where:

the operation of longitudinally advancing the slat is performed by conveying equipment; and the method further comprises operations of repeatedly determining the position of the slat by sensing orientation of the conveying equipment.

5. The method of claim 1, where:

the operation of longitudinally advancing the slat is performed by conveying equipment; and the operation of determining position comprises ascertaining slat position by considering past instructions sent to the conveying equipment to institute advancement of the slat.

6. The method of claim 1, where the printing surface is concave.

7. The method of claim 1, where the printing surface is convex.

8. The method of claim 1, further comprising operations of:

prior to the operation of longitudinally advancing the slat, positioning the print heads at various distances along a slat path and arranging the print heads such that each print head laterally spans the slat path.

9. The method of claim 1, further comprising operations of constructing the print head.

10. The method of claim 1, where the printing material comprises ink.

11. The method of claim 1, where the printing material comprises a texturing substance.

12. A print head apparatus for printing on elongated slats having a laterally curved surface, comprising:

a print head casing having a printing surface forming an arc shape;

one or more wells coupled to the print head casing;

a plurality of print jet orifices defined in the printing surface; and for each print jet orifice, a supply path coupling the print jet orifice to one of the wells.

13. The apparatus of claim 12, the print head further including:

a plurality of activators, each coupled one print jet orifice and being selectively enabled to withdraw printing material from the supply path and forcibly eject the printing material out of the print head through the print jet orifice.

14. The apparatus of claim 12, the print surface being concave.

15. The apparatus of claim 12, the print surface being convex.

16. A Venetian blind printing system, comprising:

a conveyor;

one or more print heads for printing on elongated slats having a curved lateral surface, each print head comprising:

a print head casing having a printing surface forming an arc shape;

one or more wells coupled to the print head casing;

a plurality of print jet orifices defined in the printing surface;

for each print jet orifice, a supply path coupling the print jet orifice to one of the wells; and a plurality of activators, each coupled to one print jet orifice and being selectively enabled to withdraw printing material from the supply path and forcibly eject the printing material out of the print head through the print jet orifice; and a controller coupled to the conveyor and activators, the controller being programmed to operate the conveyor to longitudinally advance an elongated laterally-curved slat past the print heads and selectively activate the print jet orifices as prescribed regions of the slat pass by specific respective print jet orifices.

17. The system of claim 16, where:

the conveyor defines a slat movement path; and the print heads comprise multiple print heads distributed along the path.

18. A louvred product, manufactured by a process comprising operations of:

providing one or more print heads each having a printing surface exhibiting an arc shape approximately matching the slat's lateral curve, each print head including multiply print jets to eject print material from print jet orifices defined in the printing surface;

longitudinally advancing the slat past the print heads in series, where the curve of the slat is aligned with the arc-shaped printing surface;

at selecting positions of slat with respect to each particular print head, activating the print jets of that particular print head to eject printing material upon the curved slat.

19. The product of claim 18, the operations further comprising:

repeatedly determining the position of the slat by using sensors to ascertain the slat's position.

20. The product of claim 19, where the operation of determining position is performed using optical sensors to ascertain the slat's position.

21. The product of claim 19, where:

the operation of longitudinally advancing the slat is performed by conveying equipment; and the operation of determining position comprises ascertaining slat position by considering past instructions sent to the conveying equipment to institute advancement of the slat.

22. The product of claim 21, where the printing surface is concave.

23. The product of claim 21, where the printing surface is convex.

24. The product of claim 21, the operations further comprising:

prior to the operation of longitudinally advancing the slat, positioning the print heads at various distances along a slat path and arranging the print heads such that each print head laterally spans the slat path.

25. The product of claim 21, further comprising operations of constructing the print head.

26. The product of claim 21, where the printing material comprises ink.

27. The product of claim 21, where the printing material comprises a texturing substance.

28. The product of claim 18, where:

the operation of longitudinally advancing the slat is performed by conveying equipment; and the operations further comprise repeatedly determining the position of the slat by sensing orientation of the conveying equipment.

* * * * *

UNITED STATES PATENT AND TRADEMARK OFFICE

CERTIFICATE OF CORRECTION

PATENT NO. : 6,286,920 B1
DATED : September 11, 2001
INVENTOR(S) : Paul Anthony Ridgway It is certified that error appears in the above-identified patent and that said Letters Patent is hereby corrected as shown below:

Column 3,
Lines 1-2, change "of a concave embodiment of print" to -- of the print head --

Column 9,
Line 47, change "activators, each coupled one print jet" to -- activators, each coupled to one print jet --

Signed and Sealed this

Twenty-fifth Day of June, 2002

*Attest:*

*Attesting Officer*

JAMES E. ROGAN
*Director of the United States Patent and Trademark Office*